United States Patent [19]

Degnan et al.

[11] Patent Number: 4,938,863

[45] Date of Patent: Jul. 3, 1990

[54] METALS TOLERANT CATALYTIC CRACKING CATALYST, METHOD OF MANUFACTURE AND USE THEREOF

[75] Inventors: Thomas F. Degnan, Yardley, Pa.; Billy K. Huh, Lawrenceville, N.J.

[73] Assignee: Mobil Oil Corporation, New York, N.Y.

[21] Appl. No.: 206,242

[22] Filed: Jun. 10, 1988

[51] Int. Cl.[5] ..... C10G 11/05

[52] U.S. Cl. ..... 208/120; 208/52 CT; 208/121; 208/149; 208/251 R

[58] Field of Search ..... 208/120, 149, 251 R, 208/52 CT, 118, 119, 121; 502/516

[56] References Cited

U.S. PATENT DOCUMENTS

| | | | |
|---|---|---|---|
| 4,116,814 | 9/1978 | Zahner | 208/89 |
| 4,289,608 | 9/1981 | McArthur | 208/120 |
| 4,407,714 | 10/1983 | Myers et al. | 200/120 |
| 4,447,552 | 5/1984 | Hayes et al. | 208/52 CT |
| 4,519,897 | 5/1985 | De Jong | 208/251 R |
| 4,582,815 | 4/1986 | Bowes | 423/332 |
| 4,612,298 | 9/1986 | Hettinger et al. | 502/64 |
| 4,615,996 | 10/1986 | Occelli | 208/52 CT |
| 4,650,564 | 3/1987 | Occelli et al. | 208/52 CT |
| 4,717,467 | 1/1988 | Haddad et al. | 208/113 |
| 4,737,346 | 4/1988 | Haddad et al. | 208/161 |
| 4,747,935 | 5/1988 | Scherzer | 208/120 |
| 4,765,884 | 8/1988 | Walker et al. | 208/120 |
| 4,781,816 | 11/1988 | Lee et al. | 208/120 |
| 4,794,095 | 12/1988 | Walker et al. | 502/79 |
| 4,828,680 | 5/1989 | Green et al. | 208/120 |
| 4,846,960 | 7/1989 | Walker et al. | 208/149 |

*Primary Examiner*—Anthony McFarlane

*Attorney, Agent, or Firm*—A. J. McKillop; C. J. Speciale; R. D. Stone

[57] ABSTRACT

A catalytic cracking catalyst and process which tolerates high levels of vanadium and coke precursors in the feed is disclosed. A zeolite in an alumina free binder or coating, preferably silica, is used as the cracking catalyst. RE-USY in silica is especially preferred as it has a low affinity for vanadium, low coking characteristics and high stability. Preferably a vanadium getter additive is present as separate particles to act as a vanadium sink. The catalyst and process may be used in fluidized bed catalytic cracking (FCC) or in moving bed catalytic cracking units. A method of making a coated catalyst, by adding a layer of an alumina free material to a core of alumina containing cracking catalyst is also disclosed.

10 Claims, No Drawings

METALS TOLERANT CATALYTIC CRACKING CATALYST, METHOD OF MANUFACTURE AND USE THEREOF

BACKGROUND OF THE INVENTION

The FCC, or fluidized catalytic cracking process, is a mature process. It is used to convert relatively heavy, usually distillable, feed to more valuable lighter products. There is an increasing need in modern refineries to convert more of the "bottom of the barrel", e.g., resids or residual oil fractions to more valuable lighter products.

In the past these heavy streams were subjected to various thermal processes. Unfortunately, thermal processing alone has not proved to be a complete answer to the problem, as the products of thermal cracking are themselves relatively low valued products, such as heavy fuel oil from visbreaking or coker naphtha or coker gas oil from coking.

Residual oils have a large percentage of refractory components such as polycyclic aromatics which are difficult to crack. Resids also contain large amounts of metals which rapidly deactivate conventional catalyst. Some attempts at catalytic processing of these stocks have been made, e.g., adding relatively small amounts of residual oil to conventional FCC feed. FCC units can tolerate modest amounts of resids in the feed, e.g., 5–10 wt. percent but the heavy feeds (because of their high Conradson carbon content) increase the burning load on the regenerator and poison the catalyst, with nickel and vanadium. Limiting the amount of resid in the FCC feed has been the method of choice in controlling regeneration temperature, although consideration has been given to adding catalyst coolers. The nickel and vanadium contamination problem can be overcome to some extent by practicing metals passivation, e.g., addition of antimony to the unit to passivate the metals added with the feed. Metals passivation has allowed FCC units to continue operating with catalyst containing relatively high amounts of nickel and vanadium, but not been a complete solution. Nickel is passivated, but vanadium remains as a poison. The vanadium seems to attack the zeolite structure of modern FCC catalyst, resulting in rapid loss of catalyst activity. The exact cause of vanadium poisoning is not completely understood, but it is believed that pentavalent vanadium compounds are formed in the highly oxidizing atmosphere of conventional FCC regenerators. These compounds, particularly vanadic acid, rapidly attack the zeolite. The problem of vanadium contamination in FCC catalyst is discussed in S. G. Jarzas, Applied Catalysis, 2, 207 (1982).

Although additive materials which are selective for nickel, vanadium, and other metals in the feed can be added to compensate for higher metals feed, there are still some problems associated with this approach.

High surface area getter materials, such as alumina, have a much greater affinity for e.g., vanadium, than does the conventional cracking catalyst. There is still a competition between the alumina additive and the conventional FCC catalyst for the metals content of the hydrocarbon oil. It is very difficult to have high capture of metals on the additive, because the cracking catalyst itself contains silica/alumina as a matrix which is also an efficient metals getter. There is much catalyst, and only minor amounts of additive, so much of the metal in the feed ends up on the catalyst.

The problems are compounded by the changes that occur in the regenerator when heavy, metals laden crudes are processed. Usually these heavy materials have associated with them an abundance of coke precursors, e.g., high Conradson carbon levels. This leads to increased coke deposition on the catalyst, and increased heat generation (and higher temperatures) in the regenerator. The high temperatures and steam (from stripping steam and water of combustion of the hydrogen in hydrocarbonaceous coke) create a severe environment for long term stability of the zeolites. The vanadium levels also promote attack of the zeolite structure.

Processes trying to operate with heavy, metals laden feed, generally tried to overcome the problems associated with high temperature in the regenerator and high metals levels by adopting a more aggressive catalyst withdrawal/makeup procedure to keep the metals level on the catalyst at an acceptable level. When resort has been made to a getter material, this has allowed some reduction in catalyst withdrawal/makeup rates, but quite a lot of getter material must be added to efficiently act as a sink for vanadium, because of the aforementioned competition between the getter material and the conventional catalytic cracking catalyst.

We have now discovered a catalyst which can be used in these severe conditions and which tends to avoid the vanadium problem. We eliminate from the catalyst surface all materials which would act as efficient vanadium sinks. In effect, we have created "Teflon catalyst" to which no vanadium will stick.

BRIEF SUMMARY OF THE INVENTION

Accordingly, the present invention provides a catalytic cracking catalyst comprising a rare earth ultra stable Y (RE-USY) in a binder characterized in that an alumina-free binder is used.

In another embodiment the present invention provides a method of making catalytic cracking catalyst comprising coating a zeolite cracking catalyst having a relatively high affinity for vanadium with a coating of a porous, alumina free material having a vanadium affinity at least an order of magnitude lower than the cracking catalyst.

In another embodiment a catalytic cracking process for the cracking of a heavy, vanadium containing, oil to lighter more valuable products over a circulating inventory of cracking catalyst having cracking activity and affinity for vanadium characterized by use of a circulating inventory of catalyst comprising zeolite cracking catalyst in an alumina free binder and separate getter additive with reduced cracking activity as compared to the cracking catalyst, and having a greater affinity for vanadium than the cracking catalyst.

DETAILED DESCRIPTION

The invention relates to a new catalyst, to a blend of this catalyst with a metal getter and the use in catalytic cracking of the catalyst and preferably of the blend. Each part will be discussed below.

Catalytic Cracking Process

The catalytic cracking process is well known. Either fluid bed catalytic cracking (FCC) of Thermofor moving bed (TCC) catalytic cracking may be used. More details about the FCC process are disclosed in U.S. Pat. Nos. 3,904,540, 3,886,060, and 4,654,060, which are incorporated by reference.

The FCC process uses fluidizable catalyst particles, typically 10–100 microns in average diameter, with many units having an average particle size of about 80 microns.

TCC units use blends, pellets, or extrudate in a moving bed. Catalyst size can range from 0.1 mm to 10 mm but most units use catalyst with an average particle size of about 1.5–3.5 mm.

Zeolite

An essential part of the catalyst and blend of the present invention is a zeolite which is either binder free, in an alumina-free binder, or coated with a surface which has a low affinity for metals contained in hydrocarbons, e.g., a silica coating.

Zeolites which can be used in the present invention are any relatively high silica zeolites, preferably those having silica:alumina ratios greater than 5:1, and more preferably having much higher silica:alumina ratios.

These alumina rich zeolites, or high silica zeolites in an alumina rich matrix, may be made suitable for use herein by coating them with an alumina free layer or shell, discussed at greater length hereafter.

Zeolite X, and many naturally occurring zeolites having silica:alumina ratios from 1:1 to 1:3 are generally not suitable because the alumina content of the zeolite act to some extent as a vanadium sink.

Zeolite Y, preferably zeolite Y which has been dealuminated to a 6:1–20:1 silica:alumina ratio, or even much higher, is eminently suitable for use herein. Ultra stable USY-type zeolites are well known and described, for example, in U.S. Pat. Nos. 3,293,192 and 3,402,996, which are incorporated herein for reference. Ultrahydrophobic (UHP) Y is an even more severely dealuminated Y zeolite which may be used herein.

Especially preferred for use herein are the pentasil zeolites, such as ZSM-5. Preferred pentasil zeolites are those having a Constraint Index of 1–12 and silica:alumina ratios in excess of 10:1, preferably in excess of 30:1 100:1, 500:1, and even higher. ZSM-5, ZSM-11, and similar materials are highly preferred for use herein. More details on ZSM-5 are disclosed in U.S. Pat. No. 3,700,580 (RE No. 28389), incorporated herein by reference.

Any of the zeolites used herein may have additional components incorporated into the zeolite, by conventional means, such as ion exchange or impregnation.

Binder Free Zeolite

Binder free zeolites may be used herein. These materials, sometimes referred to as self-bound zeolites can be made according to the method of U.S. Pat. No. 4,582,815 incorporated herein by reference.

Binders

Although, binder-free zeolites can be used, it is usually preferred to encapsulate or incorporate the zeolite within a binder or matrix material. This is because most zeolites are soft and fragile, and are not suitable use in most hydrocarbon conversion processes. Although, any non-alumina binder can be used, silica is a preferred binder material. Preferably, the catalyst comprises 5–95% zeolite, with the remainder being silica.

For use in the catalytic cracking process, operation with 5–40% zeolite in a silica binder gives optimum results.

Binder Acidity

The binder used herein for the metals tolerant catalyst should have little or no cracking activity. Preferably, the binder has no more than 1/10th the cracking activity of conventional binders used for conventional cracking catalyst.

The well known alpha test is a good way to estimate the cracking activity of a binder, and the alpha test may be useful as a screening test to make an initial determination as to the suitability of a low acidity binder for use herein. The alpha test uses a light hydrocarbon feed, and is not necessarily a predictor of what heavy, polynuclear aromatic molecules will do in a catalytic cracking unit. A better prediction as to the suitability of a low acidity binder can be made using model heavy feeds containing, e.g., porphyrins, etc., which are closer to the feedstocks that will be processed in the present invention.

Regardless of the test protocol used, the low acidity binders used herein should preferably have only 10% of the cracking activity of conventional binders, and more preferably less than 5% of the cracking activity of conventional catalyst.

Expressed as alpha, the low acidity binder should have an alpha less than 1, preferably less than 0.1 and more preferably less than 0.05. An alpha test is described in U.S. Pat. No. 3,543,078, incorporated herein by reference.

Alumina Free Layer

Many alumina rich catalysts, including zeolites bound in a silica-alumina matrix, can be made suitable for use herein by encapsulating or coating the alumina rich catalyst with a layer which has a low affinity for the metals contained in heavy hydrocarbon oils. This affinity can easily be tested using the lab scale FCC unit used for the examples discussed hereafter, or by using another equivalent test procedure. When a silica layer (or other alumina free layer) is placed outside an alumina containing catalyst, the hydrocarbon reactants can still pass through the silica layer for catalytic conversion while the metal contaminants tend to be repelled by the silica coating.

Low metals affinity correlates fairly well with the surface energy of the material involved. Expressed this way, the metals resistant coating should have surface free energy of less than 10 kcal/g mole.

A silica coating is preferred. It can be put on a fluidizable FCC catalyst by using a silica sol and then spray drying. A conventional catalyst, e.g., RE-USY in a silica/alumina matrix, can be re-slurried in a silica sol and then spray dried.

A silica coating can be placed on bead, extrudate, or pilled catalyst by spraying or immersing the preformed catalyst or catalyst precursor in a silica source. Any other means or incorporating a layer silica on the outside of a formed particle can also be used. The silica source can be a silica sol, water glass, or other similar highly siliceous material.

Rare Earths

Incorporation of rare earths by ion exchange into the zeolites is beneficial for several reasons. The thermal stability of large pore zeolites is improved by incorporation of rare earths. This is especially important when processing heavy, residual feeds, because these materials tend to deposit a lot of hydrocarbonaceous coke on the cracking catalyst. This coke forms water of combustion, or steam, in the catalytic cracking regenerator. Resid feeds frequently deposit very high levels of coke on catalysts resulting in high regenerator temperatures, so that the deactivating effect of steam is exacerbated by the high temperatures in the regenerator.

Small amounts of rare earth also minimize hydrogen transfer. In a rare earth exchanged USY zeolite, the acid sites are fewer but stronger. This minimizes coke formation.

Catalyst activity is also improved to some extent by incorporating small amounts of rare earths in the zeolites. Adding 3–7% $RE_2O_3$ to zeolite was reported to significantly increase catalytic activity by Scherzer J, et al, Ind. Eng Chem. Prop Res. Dev. 1978, 17, page 219.

RE-USY Catalyst

The preferred catalyst is a Rare Earth Ultra Stable Y (RE-USY) in an alumina free binder or matrix. The RE-USY in an alumina free matrix has very low coking rates. This is highly beneficial when processing heavy feeds with high Conradson carbon levels, because the unit is thrown out of heat balance by the addition of such heavy feeds.

RE-USY zeolite and its use in catalytic cracking with a silica/alumina binder are not, per se, novel. The preparation and use of these materials is discussed by J. S. Magee et al in "Octane Catalysts Contain Special Sieves," OGJ, May 27, 1985, page 62. RE-USY zeolites in conventional amorphous matrixes such as silica alumina are believed to be commercially available from Davison, as reported in U.S. Pat. No. 4,4667,780, which is incorporated by reference.

The preferred properties of the RE-USY/alumina free binder are:

1–20 wt % Rare Earth Content,
Size: 50–200 Microns
Wt % Zeolite: 1–25%; most preferably 5 to 15%
Binder: Silica

Conventional Cracking Catalyst

The process of the present invention also works very well when large amounts of conventional cracking catalysts are present. The catalytic cracking units always operate with an inventory of equilibrium catalyst. When a shift is made to heavy crudes, the equilibrium catalyst rapidly loses activity and becomes contaminated with metal. The catalyst of the invention, e.g., RE-USY/-$SiO_2$, can be used as an additive catalyst in such situations. The RE-USY will provide the necessary catalytic activity needed to obtain efficient catalytic cracking, while the conventional catalyst will act as a metals sink.

Shape Selective Zeolite as Additive

The process of the present invention works well when shape-selective zeolite catalysts are present either in the conventional catalyst, or in the catalyst of the invention, e.g., a silica bound RE-USY catalyst, or present as a separate additive. Preferably the ZSM-5, or other shape selective zeolite, is also used in a substantially alumina free binder to minimize deposition of vanadium on the ZSM-5 additive. More details on preferred shape selective zeolites are provided in U.S. Pat. Nos. 3,758,403; 4,416,765; 4,522,705, 4,309,279 and 4,552,648, which are incorporated herein by reference.

Use of binder free, or silica-bound, ZSM-5 having relatively high silica-alumina ratios is preferred. An ideal catalyst for use herein is disclosed in Bowes, U.S. Pat. No. 4,582,815, which is incorporated herein by reference.

Getter Additive

The process of the present invention works extraordinarily well when a blend or physical mixture of low metals affinity cracking catalyst and a metal "getter" additive, which has a high affinity for metal, is used. The metals getter material must have certain chemical properties (primarily an affinity for vanadium) and, preferably, certain physical properties that permit segregation of getter material from conventional catalyst at some point in the catalytic cracking unit.

The getter material should have a greater affinity for metals such as nickel and vanadium than the conventional FCC catalyst. Any material which will preferentially adsorb vanadium or nickel (and to a lesser extent sodium) may be used in the present invention. The getter material need not have significant catalytic cracking activity. Its function is to adsorb metal contaminants that would otherwise accumulate on the conventional catalytic cracking catalyst, or on the siliceous zeolites of the process of the invention. The getter material will therefore adsorb metals and therefore prevent them from damaging the zeolite. It is also beneficial but not essential to minimize the residence time of the getter in the conventional FCC regenerator. It is beneficial to minimize the contact time of the getter with the feed in the reaction zone. The effective residence time of feed in contact with metal in the cracking reaction can be minimized by using a relatively heavy getter material, in the base of the riser reactor. This will mean that only 5–10% by length of the riser reactor will be devoted to demetallation. Expressed as hydrocarbon residence time at cracking conditions, less than 25% of the reaction zone can be devoted to removal of metals.

Depending on the feed properties, and the heat balance requirements of the unit, an extremely long residence time of getter material in the base or elutriating section of the riser may be tolerated. This is because the heavy crudes contemplated for use herein rapidly deposit hydrocarbonaceous coke on catalyst (or getter material). This coke is itself a very efficient metal absorber. Thus, it is also contemplated to use herein a heavy getter material which as a virgin material has little activity for demetallation, but which acquires the desired properties during use. As the getter accumulates coke, this newly formed coke has a higher affinity for metals than the conventional FCC catalyst.

Relatively light, low density getters are also contemplated for use herein. Such materials cannot, in a conventional riser reactor, be separated by elutriation at the base of the riser. The light getters must remain with the catalyst through the entire length of the riser. Light getter materials will have a slightly shorter residence time in the reactor than the conventional catalyst, because the conventional catalyst will have a somewhat higher settling velocity.

It is essential that the light getter materials, when used, have a relatively greater affinity for metals than the catalyst, preferably an order of magnitude more affinity. This is fairly easy to achieve because the light getter materials can be of very fine particle size, (e.g., less than 20 microns) and can be selected solely for their metals affinity characteristics.

When using light or fine getter material, a relatively large amount of this material will be lost per pass through the reactor. This is because the light material will tend to be blown out with reactor effluent, or, if some of it is comingled with conventional catalyst charged to the conventional regenerator, will be recovered with the flue gas. This relatively high loss of getter additive is beneficial, as this material should be removed from the unit once it becomes contaminated with metals.

The physical properties of the heavy or coarse, getter material and of fine getter material are listed below:

| Physical Properties | Suitable | Preferred | Most Preferred |
|---|---|---|---|
| | Coarse Getter Material | | |
| Particle Size, microns | 80–500 | 200–500 | 400 |
| Particle Density g/cc | 0.8–2.2 | 1.5–2.2 | 1.5–2.0 |
| Pore Volume, cc/g | 0.2–0.4 | 0.2–0.4 | 0.2–0.4 |
| | Fine Getter Material | | |
| Particle Size, microns | 10–50 | 10–40 | 20–40 |
| Density g/cc | 0.7–1.5 | 0.7–1.3 | 0.7–1.3 |
| Pore Volume cc/g | 0.5–1.2 | 0.5–1.2 | 0.5–1.2 |

The process of the present invention can use any getter additive in any size or any manner of addition. The invention is not, however, the getter materials, but rather the combination of our catalyst and getter materials.

When most or all of the cracking catalyst is, e.g., RE-USY in an alumina free binder, practically any getter will work, because even poor getters will have a significantly higher vanadium affinities than our cracking catalyst.

The physical blend of a zeolite containing catalyst with an alumina free exterior and separate particles of an additive with a relative high affinity for vanadium is believed to be novel.

The blend, exclusive of conventional cracking catalyst present, can comprise from 0.1–50 wt% metals scavenging additive, with the reminder comprising the zeolite containing catalyst.

Preferably, the metal scavenging additive is 0.1–10 wt% of the blend, while the low metals affinity zeolite containing catalyst comprises 90–99.9 wt% of the blend.

EXPERIMENTS

Physical mixtures of various solids were tested to determine relative affinities for vanadium and coke under simulated FCC cracking conditions (1000° F., 1 LHSV 700–1000 SCFB helium). By cracking an Arab light gas oil doped with 0.43 wt.% vanadium as vanadium napthenate over 50:50 wt.% mixtures of 2 differently sized materials in a dense fluid bed and then separating the particles, we determined the relative amount of vanadium and coke deposited on each material.

The feed properties are listed in Table 1.

TABLE 1

| Feed Properties | |
|---|---|
| Charge Stock | 84D5086 |
| API | 20.0 |
| Hydrogen, Wt % | 12.2 |
| Sulfur, Wt % | 2.61 |
| Nitrogen, ppm | 930 |
| Basic Nitrogen, ppm | 294 |
| Pour Point, °F. | 115 |
| Aromatics, Wt % (Silica Gel) | 61 |
| Vanadium, as Vanadyl-naphthenate | 0.43 wt % |
| Distillation, Wt % D2887 | |
| IBP | 736 |
| 5% | 831 |
| 10 | 865 |

TABLE 1-continued

| Feed Properties | |
|---|---|
| 20 | 897 |
| 30 | 918 |
| 40 | 935 |
| 50 | 953 |
| 60 | 971 |
| 70 | 990 |

Table 2, below, shows that alumina has a much higher affinity for vanadium than does silica. By physically mixing alumina with RE-USY/$SiO_2$ catalyst more than 80% of the total vanadium content of the feed can be removed by the alumina. The FCC catalyst is a sample of commercial equilibrium catalyst withdrawn from a unit operating with a CO burning regenerator (1300° F., 3% $O_2$ in flue gas).

TABLE 2

| Metal and Coke Partitioning Data | | | |
|---|---|---|---|
| Catalyst/Inert | Mesh Size | V (ppm) | Coke (%) |
| FCC | 140/170 | 5 | 1.30 |
| $Al_2O_3$ | 40/80 | 254 | 2.00 |
| FCC | 140/170 | 78 | 0.01 |
| $SiO_2$ | 40/80 | 145 | 0.47 |
| RE-USY/$SiO_2$ | 100/160 | 62 | 5.71 |
| $Al_2O_3$ | 40/80 | 285 | 5.28 |

If we were practicing the invention now, we would use an RE-USY/$SiO_2$ catalyst containing 12 wt.% RE-USY zeolite, the remainder being silica binder. The catalyst would contain 0.1–2 wt% rare earth.

We would use a blend of RE-USY/$SiO_2$ and getter additive. The blend would contain 1–60 wt.% getter additive and 99–40 wt.% RE-USY/$SiO_2$. Our preferred getter is a soft alumina. The size and amount of the getter additive is not as important as seeing that sufficient additive is present to adsorb most, and preferably more than 80%, of the vanadium in the feed. This can be easily determined by analyzing the equilibrium catalyst, during operations or by conducting lab tests with the heavy feed and additive and cracking catalyst of interest.

We claim:

1. A catalytic cracking process for the cracking of a heavy, vanadium containing oil to lighter more valuable products over a circulating inventory of cracking catalyst having cracking activity and affinity for vanadium characterized by use of a circulating inventory of catalyst comprising zeolite cracking catalyst coated with a coating consisting essentially of silica or in a binder consisting essential of silica and separate getter additive with reduced cracking activity as compared to the cracking catalyst, and having a greater affinity for vanadium than the cracking catalyst.

2. The process of claim 1 further characterized in that the zeolite catalyst comprises 5 to 40 wt % RE-USY in a binder of $SiO_2$.

3. The process of claim 1 further characterized the zeolite cracking catalyst comprises an alumina containing material coated with silica.

4. The process of claim 1 further characterized in that a mixture of zeolite catalyst and separate particles of a vanadium getter additive are used, and the mixture comprises 10 to 50 wt % vanadium getter additive.

5. The process of claim 4 wherein the getter additive is selected from the group of separate particles of $Al_2O_3$, MgO, activated carbon, coke, clay, and bauxite.

6. The process of claim 1 further characterized in that the catalytic cracking process is a fluidized catalytic cracking process.

7. The process of claim 1 further characterized in that the catalytic cracking process is a moving bed catalytic cracking process.

8. The process of claim 1 wherein the zeolite cracking catalyst comprises 1 to 25 wt % RE-USY in a silica binder.

9. The process of claim 1 further characterized in that the catalyst has an average particle diameter of 10–100 microns.

10. The process of claim 1 further characterized in that the catalyst is in the form of an extrudate of 0.1–10 mm.

* * * * *